US009664076B2

(12) United States Patent
Evans et al.

(10) Patent No.: US 9,664,076 B2
(45) Date of Patent: May 30, 2017

(54) SWITCHABLE FINGER FOLLOWER WITH LASH ADJUSTMENT SHIM

(71) Applicant: Schaeffler Technologies AG & Co. KG, Herzogenaurach (DE)

(72) Inventors: Matthew Evans, Warren, MI (US); Debora Manther, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 95 days.

(21) Appl. No.: 14/744,401

(22) Filed: Jun. 19, 2015

(65) Prior Publication Data

US 2016/0003111 A1 Jan. 7, 2016

Related U.S. Application Data

(60) Provisional application No. 62/020,573, filed on Jul. 3, 2014.

(51) Int. Cl.

| | |
|---|---|
| ***F01L 1/18*** | (2006.01) |
| ***F01L 13/00*** | (2006.01) |
| *F01L 1/20* | (2006.01) |

(52) U.S. Cl.

CPC ..... *F01L 13/0063* (2013.01); *F01L 1/185* (2013.01); *F01L 1/18* (2013.01); *F01L 1/205* (2013.01)

(58) Field of Classification Search

CPC ... F01L 1/18; F01L 1/185; F01L 1/205; F01L 13/0063

USPC ..... 123/90.16, 90.39, 90.44

See application file for complete search history.

(56) References Cited

U.S. PATENT DOCUMENTS

| | | | | |
|---|---|---|---|---|
| 7,174,869 | B2 | 2/2007 | Proschko et al. | |
| 7,661,400 | B2 * | 2/2010 | Seitz | F01L 1/185 123/90.39 |
| 7,909,007 | B2 | 3/2011 | Manther et al. | |
| 8,251,032 | B2 | 8/2012 | Manther | |

* cited by examiner

*Primary Examiner* — Ching Chang

(74) *Attorney, Agent, or Firm* — Volpe and Koenig, P.C.

(57) ABSTRACT

A switchable finger follower, including an inner lever and an outer lever. The outer lever is mounted for pivoting movement to the inner lever. A coupling device is located on one of the inner or outer levers and has a coupling pin arranged to move between a locking position, in which the inner and outer levers are connected together for movement in an activation direction, and an unlocked position, in which the inner lever is pivotable relative to the outer lever. A coupling projection is located on the other of the inner or outer lever. The coupling pin engages beneath a coupling surface of the projection in the locking position, and a stop surface of the projection contacts a second stop surface on the one of the inner lever or the outer lever. The second stop surface is located on a removable shim that is replaceable for lash adjustment.

9 Claims, 4 Drawing Sheets

SWITCHABLE FINGER FOLLOWER WITH LASH ADJUSTMENT SHIM

INCORPORATION BY REFERENCE

The following documents are incorporated herein by reference as if fully set forth: U.S. Provisional Application No. 62/020,573, filed Jul. 3, 2014.

FIELD OF INVENTION

The invention relates to roller finger followers that are used in overhead cam-type internal combustion engines and, more particularly, to switchable roller finger followers that have a high lift and a low or no lift mode.

BACKGROUND

Switchable roller finger followers are known. See, for example, U.S. Pat. No. 7,174,869. Such finger followers have an outer lever pivotably mounted outside an inner lever and a roller rotatably mounted on a transverse axle in a slot in the inner lever. Here, the top surface of the outer lever can act as a contact surface for a high lift cam and the top surface of the roller acts as a contact surface for a low lift cam. A coupling element is mounted at one end of the finger follower and oil from an oil source is used to activate the coupling element. When the coupling element is activated, it locks the outer lever to the inner lever and requires the follower to follow the high lift cam and transfer the lift to the valve stem of an associated intake or exhaust valve. When the coupling element is deactivated, the outer lever is free to pivot relative to the inner lever, with the motion being absorbed by a lost-motion spring, and the motion of the low lift cam is transferred by the inner lever to the valve stem. This movement by the outer lever is conventionally referred to as the lost motion stroke.

Conventionally, the outer lever is a unitary structure such that the coupling element need only operate on one part of the outer lever. Typically, the coupling device operates on a yoke portion of the outer lever, the yoke portion being transverse to the longitudinal axis of the finger follower. Conventionally, the roller axle is staked to the inner lever to maintain its lateral position relative to the inner lever. U.S. Pat. No. 7,909,007 discloses a roller finger follower of this type. This provides a lost motion spring to maintain contact between the cam follower and the cam.

U.S. Pat. No. 8,251,032 discloses a prior switchable roller finger follower of one inventor in which two locking pins of the coupling device are extended outwardly to a locked position under each of outer arms via oil pressure, and are uncoupled via separate return springs when insufficient oil pressure is present. U.S. Pat. No. 8,251,032 is incorporated herein by reference as if fully set forth.

Switchable finger followers that provide for valve deactivation are also known in which the inner and outer levers are coupled together by a coupling element in the active state, and are uncoupled in the deactivated state, resulting in no lift being transferred to the valve stem.

One issue in these prior known adjusters is the lack of lash adjustment for the coupling element that connects the inner and outer levers in at least one operating state.

It would be desirable to provide a switchable finger follower of the general type noted above with simple manufacturing, as well as the possibility for adjusting the lash of the coupling element between the inner and outer levers.

SUMMARY

Briefly stated, a switchable roller finger follower having at least two lift modes for a valve train of an internal combustion engine is provided. The lift modes can be a no lift-lift mode or a low lift-high lift mode. The switchable roller ringer follower includes an inner lever having first and second ends, preferably with a center recess in which a roller is mounted by a transverse axle as a cam contact surface. An outer lever is provided with two outer arms that extend along longitudinal sides of the inner lever, with the outer lever being mounted for pivoting movement at a first end of the inner lever by a pivot axle. A lost motion spring is connected between the inner lever and the outer lever. A coupling device is located on one of the inner lever or the outer lever on an end opposite from the pivot axle and includes a coupling pin arranged to move in a longitudinal direction between a locking position, in which the inner lever and the outer lever are connected together for movement at least in an activation direction of a valve, and an unlocked position, in which the inner lever is pivotable relative to the outer lever. A coupling projection with a coupling surface and a stop surface is located on the other of the inner lever or the outer lever. The coupling pin engages beneath the coupling surface in the locking position, and the stop surface of the coupling projection contacts a second stop surface on the one of the inner lever or the outer lever with the coupling device. The second stop surface is located on a removable shim connected to the one of the inner lever or outer lever.

In a preferred arrangement, the removable shim has a predetermined thickness and is selected to adjust a coupling lash of the coupling device. The removable shim is preferably made of hardened steel.

In one preferred arrangement, the removable shim is located in a slot in the one of the inner lever or the outer lever with the coupling device, and is connected to a hardened pin.

The removable shim may include a recess that can be snapped onto the hardened pin in the slot, or the pin can be inserted through an opening in the shim.

In one preferred arrangement, a plurality of removable shims having different thickness are provided, and one of the removable shims with a desired thickness is connected to the one of the inner lever and outer lever with the slot to adjust a coupling lash of the coupling device.

In one preferred arrangement, the coupling device is located on the outer lever, and in the unlocked position, the roller ringer follower provides a zero lift mode of operation. In another preferred arrangement, the coupling device is located on the inner lever, and in the locked position, the roller finger follower provides a high lift. In this arrangement, the high lift cam contact surfaces are preferably located on the outer arms of the outer lever, and when the coupling device is in the unlocked position, the outer lever moves relative to the inner lever and the motion is absorbed by the lost motion springs.

In another aspect, a method of adjusting the lash of a coupling device for a switchable roller finger follower is provided. The method includes providing a switchable roller finger follower having two lift modes, which can be a no lift-lift or low lift-high lift arrangement. A switchable roller finger follower as noted above is provided and the method includes assembling and/or installing the switchable roller finger follower and measuring a lash of the coupling device between the coupling surface and the coupling pin in the locking position. A removable shim having a required thickness to provide a desired coupling device lash is installed and forms the second stop surface. Preferably, the removable shim is selected with the required thickness that results in a coupling device lash preferably being in the range of 25 to 200 microns for most motor vehicle applications.

Using one or more of these features results in a switchable finger follower with reduced complexity with additional functionality that allows for lash adjustment of the coupling device in a simple manner.

Other aspects of the invention are described below and in the claims, and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
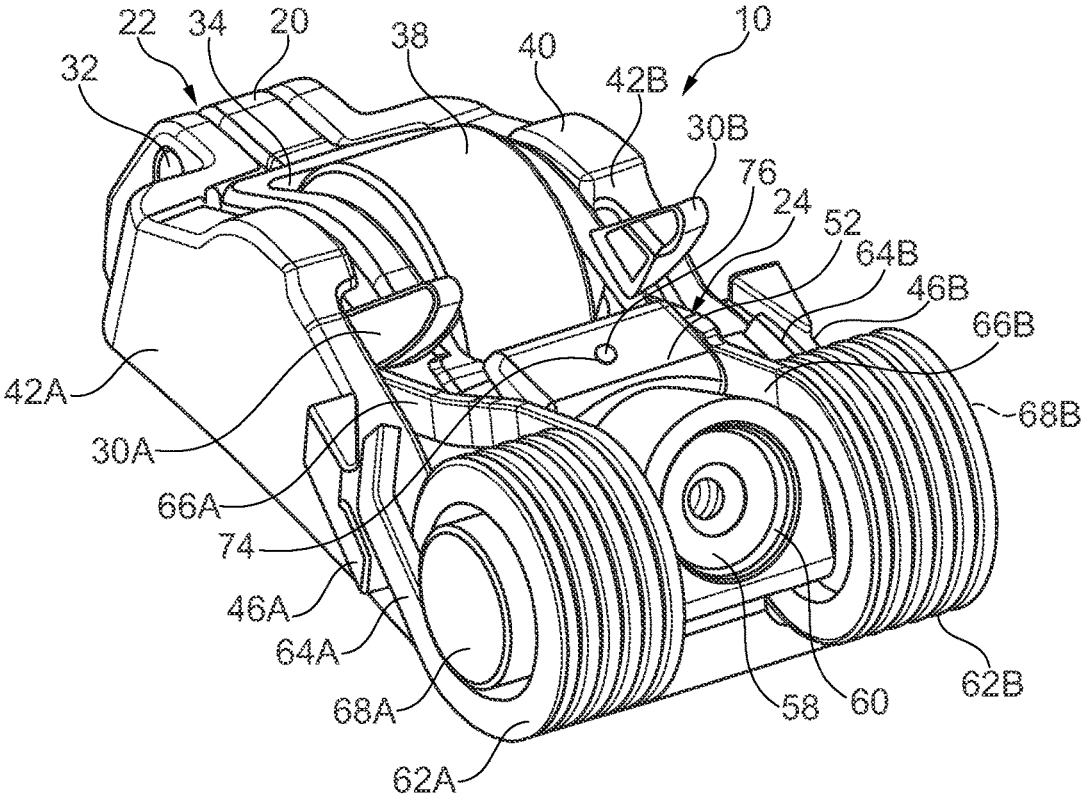
FIG. 1 is a perspective view of a switchable roller finger follower according to a first embodiment of the invention with no lift and lift modes of operation.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIG. 1, a first embodiment of the switchable finger follower 10 according to the present invention is shown. The switchable roller finger follower 10 has at least two lift modes of operation for a valve train of an internal combustion engine, not shown. In the first embodiment of the switchable roller finger follower 10, the lift modes are a zero lift mode and a lift mode which allows an associated valve to be deactivated depending upon the particular operating conditions for the engine.

The switchable roller finger follower 10 includes an inner lever 20 having a first end 22 and a second end 24. A center recess 34 is preferably provided in which a roller 38 is mounted by a transverse axle 36. However, the inner lever 20 could also just include a slider pad instead of a roller. As shown in detail in FIGS. 2 and 3, a coupling projection 26 is located on the second end 24 of the inner lever and includes a coupling surface 27 and a stop surface 28. Lost motion spring contact arms 30A, 30B are located on each side of the inner lever 20, as shown in FIGS. 1-3.

An outer lever 40 with two outer arms 42A, 42B that extend along longitudinal sides of the inner lever 20 is provided. The outer lever 40 is mounted for pivoting movement at the first end 22 of the inner lever 20 by a pivot axle 32. As shown in detail in FIGS. 1 and 4, the outer lever 40 includes lost motion spring catches 46A, 46B. Additionally, spring posts 68A, 68B are located at the second end of the outer lever 40 on which most lost motion springs 62A, 62B are installed as shown in detail in FIG. 1. These lost motion springs 62A, 62B include lower spring arms 64A, 64B that engage the lost motion spring catches 46A, 46B on the outer lever 40 as well as upper spring arms 66A, 66B which are engaged beneath the lost motion spring arms 30A, 30B on the inner lever 20. The lost motion springs 62A, 62B are configured to apply an upward force against the lost motion spring arms 30A, 30B on the inner lever 20 so that the inner lever 20 is biased upwardly so the roller 38 is at an upper most position.

Figure 2:
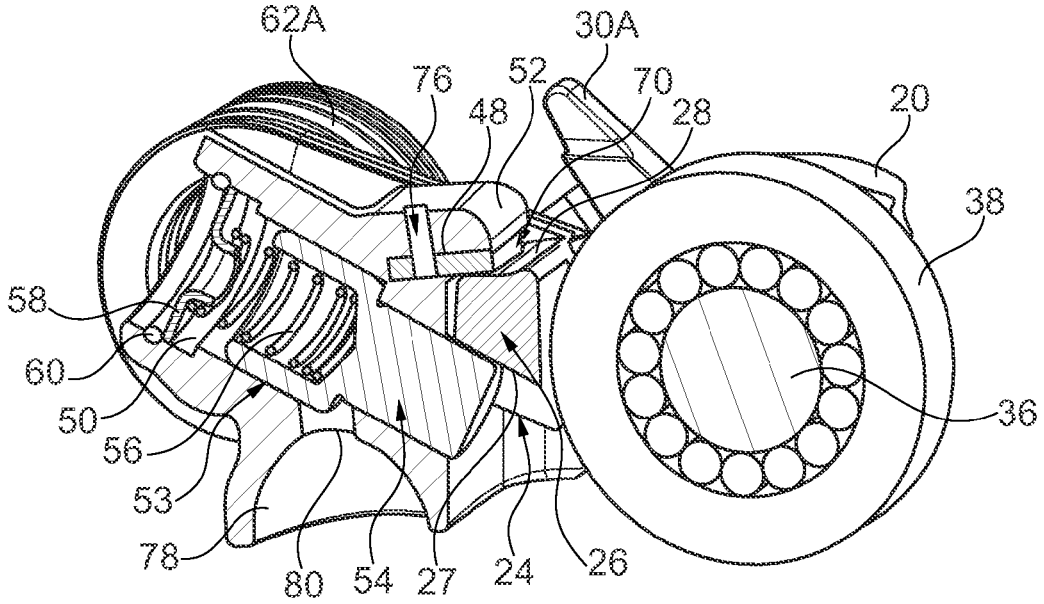
FIG. 2 is a cross-sectional view of a portion of the switchable roller finger follower of FIG. 1, shown partially in perspective.
Figure 3:
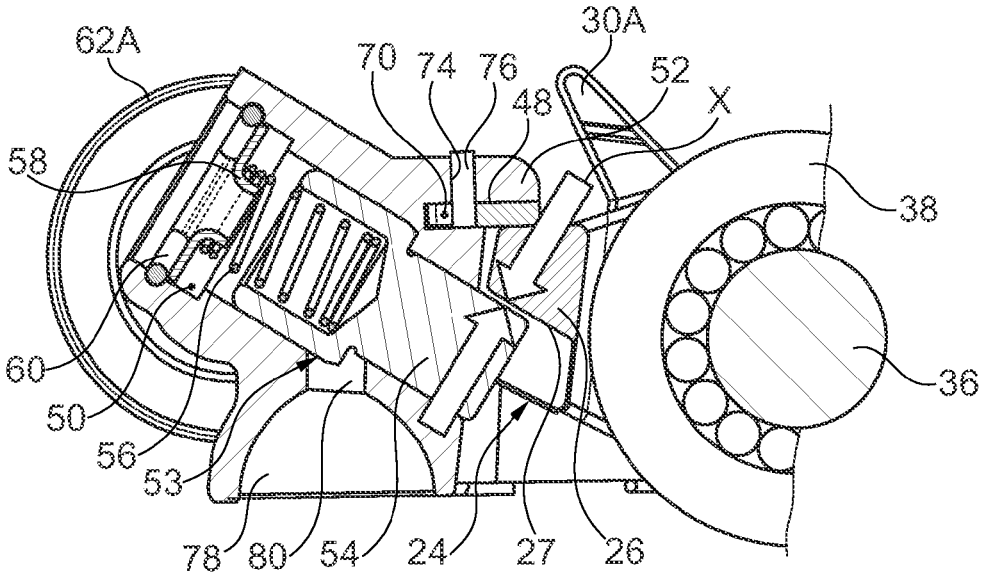
FIG. 3 is a cross-section view of the switchable roller finger follower of FIG. 1 taken through the coupling device.

Still with reference to FIGS. 2 and 3, the outer lever 40 includes a stop block 52 that extends into an area above the stop surface 28 on the inner lever 20. A slot 48 for a lash adjusting shim 70 is located in the stop block 52. The shim 70 is held in position via a pin 76 installed in a pin hole 74 that extends in the stop block 52.

Figure 4:
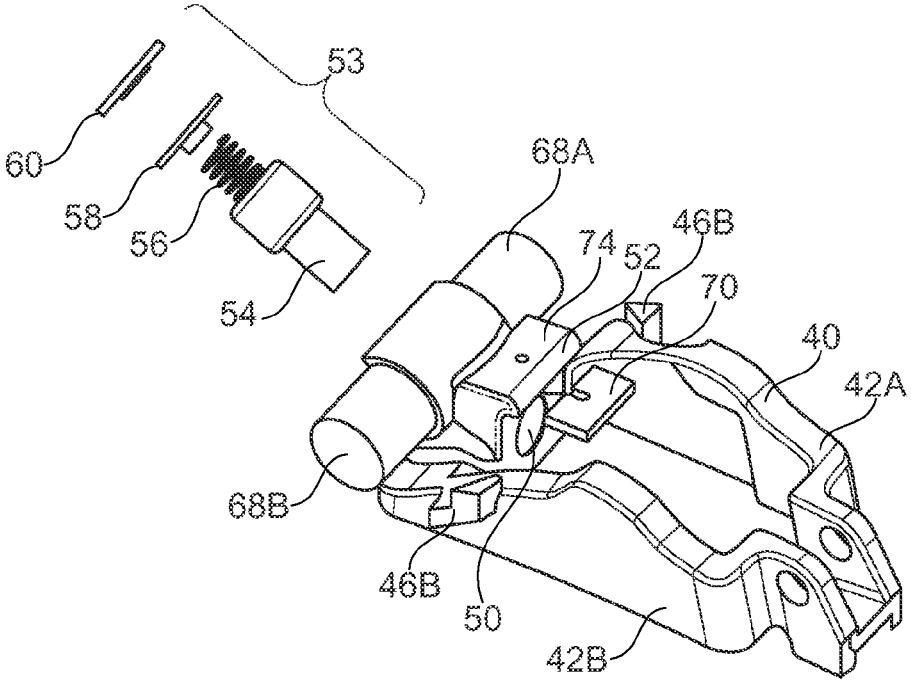
FIG. 4 is an exploded view of the outer arm assembly for the switchable roller finger follower of FIG. 1.

A coupling device 53 is located on one of the inner lever 20 or the outer lever 40, and in the first preferred embodiment, as shown in to FIGS. 2-4, the coupling device 53 is located on the outer lever 40 on an end opposite from the pivot axle 32. The coupling device 53 includes a coupling pin 54 arranged to move in a longitudinal direction between a locking position, shown in FIGS. 2 and 3, in which the inner lever 20 and the outer lever 40 are connected together for movement at least in an activation direction of a valve, and an unlocked position, in which the outer lever 40 is pivotable relative to the inner lever 20. The coupling device 53 further includes a spring 56 which biases the coupling pin 54 to the locked position as shown in FIGS. 2 and 3. The spring 56 is held in position via a spring retainer 58 and a lock ring 60. The pin 54, spring 56, spring retainer 58 and snap ring 60 are all located within a stepped bore 50 in the second end of the outer arm 40. A socket 78 for receiving a support head which can be located on a lash adjusting device in the engine block or engine head is located on the bottom side of the outer lever 40. An oil passage 80 is located in the socket 78 and leads to the bore 50 in an area of a shoulder on the coupling pin 54. In the embodiment of the switchable roller finger follower 10 shown in FIGS. 1-4, oil pressure applied via the oil passage 80 acts on the shoulder on the coupling pin 54 in order to move the pin 54 against this force of the spring 56 into an unlocked position which allows the inner lever 20 to move up and down relative to the outer lever about the pivot axle 32.

Still with reference to FIGS. 2 and 3, the coupling projection 26, which in the first preferred embodiment is located on the inner lever 20, contacts the shim 70 with the stop surface 28 and is held with lash indicated at X in FIG. 3 by the coupling pin 54 which engages beneath the coupling surface 27 in the locking position. The stop surface 28 of the coupling projection 36 contacts a second stop surface provided by the removable shim 70 located in the first preferred embodiment on the outer lever 40.

Figure 5:
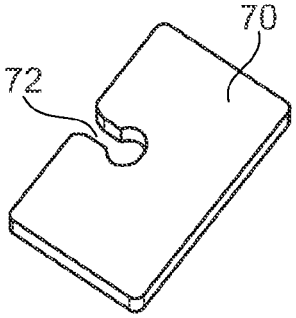
FIG. 5 is a detail perspective view of the shim used for lash adjustment.
Figure 6A:
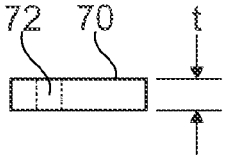
FIGS. 6A-6C are side views showing shims of different thicknesses which are used in connection with the switchable roller finger follower shown in FIG. 1.
Figure 6B:
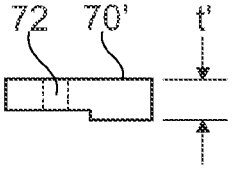
Figure 6C:
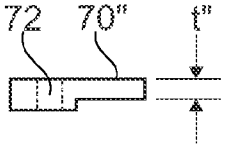

As shown in FIG. 3, the lash X between the coupling projection 26 on the inner lever 20 and the coupling pin 54 is preferably in the range of 25 to 200 microns for most motor vehicle applications in order to provide optimum functioning. The noted range is considered exemplary, and is not limiting as this could vary depending upon the particular application. The lash X often needs to be adjusted after assembly and/or during installation in order to meet the desired or required measurement range. According to the invention, this is accomplished via the shim 70, preferably configured as shown in FIG. 5 with a recess 72 that is adapted to snap around the pin 76. Alternatively, the shim 70 could include a through hole and the pin 76 could be inserted through the pin hole 74 in the stop block 52 and through the through hole in the shim 70 in order to maintain the shim position. In order to obtain the desired lash, shims 70, 70', 70", etc. as shown in FIGS. 6A-6C can be provided with different thickness t, t', t" so that once the lash X is measured, the initially installed shim 70 can be removed and replaced with a shim 70, 70', 70" of the required thickness in order to adjust the coupling lash X to the desired range. This arrangement allows for a simple adjustment to be carried out using a removable shim 70 that can be easily removed and replaced with shim(s) 70, 70', 70" of the desired thickness after assembly and/or installation of the switchable roller finger follower 10. Preferably, the removable shim 70, 70', 70" is made of hardened steel. The shim 70 can be of uniform thickness as shown in FIG. 6A, or can have a stepped thickness so that the end which is inserted in the slot 48 is the same thickness and the area of the shim 70', 70" which contacts the stop surface 28 on the coupling projection 26 of the inner lever 20 varies in order to adjust the lash X. Preferably, the removable shim 70, 70', 70" with the desired thickness is connected to the outer lever 40 in the first embodiment to adjust the coupling lash X to the desired range which can vary, depending upon the particular application.

According to the invention, it is also possible for there to be 2 or more shims 70 installed within the slot 48 that each have a thickness that adds up to the desired total thickness to adjust the coupling lash X to a desired range. A first one of the shims 70 may be used to contain the inner lever 20 within the outer arms 42A, 42B of the outer lever 40 after the lost motion spring(s) 62A, 62B have been installed. The second shim 70 (or possibly more shims) is installed later in the assembly process after the mechanical lash check so that the total thickness of the installed shims is equal to the required thickness t to achieve the desired lash.

Figure 7:
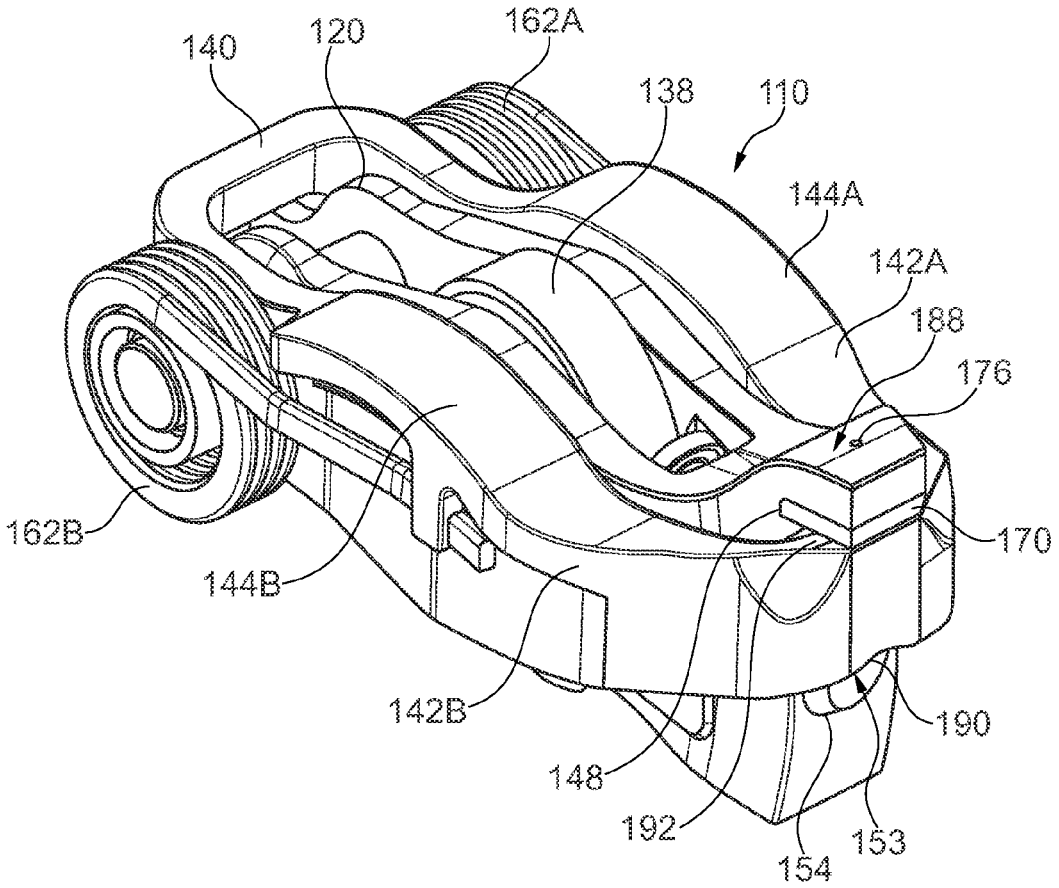
FIG. 7 is a perspective view of a second embodiment of a switchable roller finger follower providing a high-lift and low-lift modes of operation.

Referring to FIG. 7, a second embodiment of a switchable roller finger follower 110 is shown. The second embodiment of the switchable roller finger follower 110 includes a high-lift mode and low-lift mode as the two lift modes and varies from the embodiment shown in FIG. 1 in that the coupling device 153 is located in the second end of the inner arm 120. Additionally, the coupling projection 188 is located at the second end of the inner arm which also includes the slot 148 for receiving the lash adjusting shim 170, which is similar to the shims 70, 70', 70" as discussed above. Here, the shim 170 is held in position via a pin 176 located in the coupling projection 188 in a similar manner to the pin 76 located in the coupling projection 52 in the first embodiment of the switchable roller finger follower 10. The coupling device 153 includes a coupling pin 154 which, in the unlocked position, allows the outer lever 140 to pivot relative to the inner lever 120 such that the cam lift is transferred to the valve via the roller 138 connected to the inner lever 120. When the coupling pin 154 is extended position, beneath the coupling surface 190 located on the outer lever 140, the outer lever 140 is connected to the inner lever so that lift is transferred from the cam by cam contact surfaces 144A, 144B located on the outer arms 142A, 142B of the outer lever 140. Rollers could also be used in place of cam contact surfaces 144A and 144B. As shown in FIG. 7, in this arrangement, the lost motion spring 162A, 162B are located at the first end of the switchable roller finger follower 110 and function to bias the outer lever 140 upwardly relative to the inner lever in order to absorb the lost motion of the high-lift cams when the coupling device 153 is in the unlocked position. The coupling device 153 preferably includes an arrangement similar to the coupling device 53 of the first embodiment with the coupling pin 154, as indicated, which moves between a locked position and an unlocked position. The removable shim 170 provides the second stop surface which the stop surface 192 on the outer arm contacts, and the lash between the coupling surface 190 on the outer lever and the coupling pin 154 is adjusted based on the thickness of the removable shim 170.

A method of adjusting a coupling device lash for a switchable roller finger follower 10, 110 is also provided. The method includes providing a switchable roller finger follower 10, 110 having at least two lift modes for a valve train of an internal combustion engine, as described above. The switchable roller finger follower is assembled and/or installed, and the lash X of the coupling device between the coupling surface and coupling pin is measured in the locking position. The first removable shim 70, 170 is removed, if necessary, and a second removable shim 70, 70', 70", 170 having a required thickness to provide a desired coupling lash X is installed, preferably so that the resulting coupling device lash is within a desired range, which in one exemplary application is a lash of less than about 100 microns. The shim 70, 170 is removed by either disengaging it from the pin 76, 176 via a snap fit, or removing the pin 76, 176, depending upon whether the shim 70, 170 includes a recess 72, as shown in FIG. 5, or a plain hole (not shown) through which the pin 76, 176 is inserted. The new shim 70, 70', 70", 170 is installed in the same manner, wither by a snap-fit onto the pin 76, 176, or reinstallation of the pin through the hole in the shim 70, 70', 70", 170.

While the preferred embodiment of the invention has been described in detail, those skilled in the art will recognize that other changes could be made to a switchable roller finger follower without departing from the scope of the present invention. Other types of coupling arrangements could be provided and the specific configuration of the inner lever and outer arms could be varied without departing from the scope of the present invention. Accordingly, the scope of the invention should not be limited by the preferred embodiments discussed above and instead should be defined by the claims as noted below.

What is claimed is:

1. A switchable roller finger follower having at least two lift modes for a valve train of an internal combustion engine, comprising:

an inner lever having first and second ends;

an outer lever with two outer arms that extend along longitudinal sides of the inner lever, mounted for pivoting movement at the first end of the inner lever by a pivot axle;

a lost motion spring connected between the inner lever and the outer lever;

a coupling device located on one of the inner lever or the outer lever on an end opposite from the pivot axle that includes a coupling pin arranged to move in a longitudinal direction between a locking position, in which the inner lever and the outer lever are connected together for movement at least in an activation direction of a valve, and an unlocked position, in which the outer lever is pivotable relative to the inner lever;

a coupling projection with a coupling surface and a stop surface located on the other of the inner lever or the outer lever, the coupling pin engages beneath the coupling surface in the locking position and the stop surface of the coupling projection contacts a second stop surface on the one of the inner lever or the outer lever; and the second stop surface is located on a removable shim connected to the one of the inner lever or the outer lever.

2. The switchable roller finger follower of claim 1, wherein the removable shim has a predetermined thickness and is selected to adjust a coupling lash of the coupling device.

3. The switchable roller finger follower of claim 1, wherein the removable shim is made of hardened steel.

4. The switchable roller finger follower of claim 1, wherein the removable shim is located in a slot in the one of the inner or the outer lever, and is connected to a hardened pin.

5. The switchable roller finger follower of claim 4, wherein the removable shim includes a recess and is snapped onto the hardened pin in the slot.

6. The switchable roller finger follower of claim 1, wherein there are a plurality of the removable shims having different thicknesses, and one of the removable shims with a desired thickness is connected to the one of the inner lever or the outer lever to adjust a coupling lash of the coupling device to a desired value.

7. The switchable roller finger follower of claim 1, wherein the coupling device is located on the outer lever, and in the unlocked position, the roller finger follower provides zero lift.

8. The switchable roller finger follower of claim 1, wherein the coupling device is located on the inner lever, and in the locked position, the roller finger follower provides a high lift.

9. The switchable roller finger follower of claim 8, wherein high lift cam contact surfaces are located on the outer arms.

* * * * *